US012134969B2

(12) United States Patent
Pastorino et al.

(10) Patent No.: US 12,134,969 B2
(45) Date of Patent: Nov. 5, 2024

(54) ADHESIVELY ANCHORED ROCK BOLT ASSEMBLY

(71) Applicant: INNOVATIVE MINING PRODUCTS (PTY) LTD, Johannesburg (ZA)

(72) Inventors: Paolo Ettore Pastorino, Johannesburg (ZA); Rual Abreu, Johannesburg (ZA)

(73) Assignee: INNOVATIVE MINING PRODUCTS (PTY) LTD, Johannesburg (ZA)

( * ) Notice: Subject to any disclaimer, the term of this patent is extended or adjusted under 35 U.S.C. 154(b) by 88 days.

(21) Appl. No.: 17/801,163

(22) PCT Filed: Mar. 31, 2021

(86) PCT No.: PCT/ZA2021/050023
§ 371 (c)(1),
(2) Date: Aug. 19, 2022

(87) PCT Pub. No.: WO2021/203147
PCT Pub. Date: Oct. 7, 2021

(65) Prior Publication Data

US 2023/0070897 A1 Mar. 9, 2023

(30) Foreign Application Priority Data

Apr. 1, 2020 (ZA) ..... 2020/01766

(51) Int. Cl.
*E21D 20/02* (2006.01)
*E21D 21/00* (2006.01)

(52) U.S. Cl.
CPC ..... *E21D 20/025* (2013.01); *E21D 21/0026* (2013.01)

(58) Field of Classification Search
CPC . E21D 21/0026; E21D 21/0033; E21D 20/02; E21D 20/025
See application file for complete search history.

(56) References Cited

U.S. PATENT DOCUMENTS 7,381,013 B1 6/2008 Rataj et al.
2006/0127189 A1* 6/2006 Hedrick ..... E21D 21/0033 405/259.1

(Continued)

FOREIGN PATENT DOCUMENTS

CA 2 466 283 5/2003
EP 3 546 698 10/2019

(Continued)

OTHER PUBLICATIONS

International Search Report dated Sep. 1, 2021, for PCT/ZA2021/050023, 4 pp.

(Continued)

*Primary Examiner* — Frederick L Lagman
*Assistant Examiner* — Stacy N Lawson
(74) *Attorney, Agent, or Firm* — NIXON & VANDERHYE

(57) ABSTRACT

Disclosed is a rock bolt assembly including: a rock bolt with an elongate body which extends between a distal end and a proximal end and which has an integrally formed anchor portion and, where the body is not so formed, cylindrical stem portions; a tubular sleeve with a first diameter, which longitudinally extends between a first end and a second end, partially encasing the rock bolt so at least a proximal end portion of the bolt projects from the first end of the sleeve; a grout-input element which engages the rock bolt on the proximal end portion and which engages the first end of the sleeve in sealing contact; wherein, over each stem portion, the tubular sleeve is adapted along a band section by a reduction in the first diameter in a diametric plane; and wherein, over the anchor portion, the tubular sleeve retains the first diameter.

20 Claims, 7 Drawing Sheets

(56) References Cited

U.S. PATENT DOCUMENTS

| | | | | |
|---|---|---|---|---|
| 2012/0251262 | A1* | 10/2012 | Hidalgo Salgado | E21D 21/0033 411/15 |
| 2014/0037388 | A1* | 2/2014 | Ahola | F16B 13/066 405/259.5 |
| 2018/0291737 | A1* | 10/2018 | Pastorino | E21D 21/0026 |
| 2021/0071525 | A1* | 3/2021 | Cawood | E21D 21/0026 |

FOREIGN PATENT DOCUMENTS

| | | |
|---|---|---|
| WO | 2016/210456 | 12/2016 |
| WO | 2019/051512 | 3/2019 |

OTHER PUBLICATIONS

Written Opinion of the ISA dated Sep. 1, 2021, for PCT/ZA2021/050023, 6 pp.

* cited by examiner

ADHESIVELY ANCHORED ROCK BOLT ASSEMBLY

CROSS-REFERENCE TO RELATED APPLICATION(S)

This application is the U.S. national phase of International Application No. PCT/ZA2021/050023 filed Mar. 31, 2021, which designated the U.S. and claims priority to ZA 2020/01766 filed Apr. 1, 2020, the entire contents of each of which are hereby incorporated by reference.

BACKGROUND OF THE INVENTION

Field of the Invention

The invention relates to a rock bolt assembly which is adhered in a rock hole by a resinous or cementitious adhesive and which has improved grout or resin anchoring and/or stiffness properties.

Description of the Related Art

Hereinafter, the words "grout" and "resin" are used interchangeably to refer to a rock bolt or anchor which is adhered in a rock hole by a resinous or cementitious adhesive.

Providing a grouted rock bolt assembly which includes a rock bolt within a grout sleeve, is commonplace in the industry. The encasing grout sleeve provides a conduit to grout input at a proximal end of the assembly to flow to the distal end and out into an annular column between a rock-hole wall and the sleeve thus grouting the assembly within the rock hole.

The specification to PCT/ZA2016/000017 teaches just such an assembly. In this specification, a tubular sleeve at least partially encloses a rock bolt. At one end of the assembly, a mechanical anchor is provided. At an opposed end, a grout-nozzle docking bush is engaged with a proximal end of the rock bolt with a proximal end of the tubular sleeve sealingly engaging the bush. On engagement, a grout conduit is provided between an inlet to the bush and a distal end of the sleeve. When a grout nozzle is engaged with the bush, grout may be pumped into the inlet to pass through the grout conduit and emerge at the sleeve's distal end, after which the grout can flow between the assembly and the grout hole.

Whilst the sleeve provides an efficient means of channeling grout input deep into the rock hole, for optimal full column grouting, it is deleterious in load transfer from the rock bolt to the surrounding rock i.e. it reduces the anchor and/or stiffness of the installation.

To improve anchorage, the outer surface of the bolt and/or the sleeve respectively can be profiled. Profiling of the sleeve with a series of ridges or a spiral has not proven to be a total solution as the assembly is never able to function at full load capacity. This has led to the need to introduce the mechanical anchor which, at the distal end of the assembly, anchors against the rock walls. The mechanical anchor comes with added configurational complexity and cost.

Another problem is that, to achieve full column grouting, the sleeve cannot move axially relatively to the bolt. If it does, the seal between the sleeve and the bush is broken and the grout can escape at this juncture without flowing the length of the grout conduit.

The invention at least partially solves the aforementioned problems.

SUMMARY OF INVENTION

The invention provides a rock bolt assembly which includes:

- a rock bolt with an elongate body which extends between a distal end and a proximal end and which has at least one integrally formed anchor portion and, where the body is not so formed, a plurality of cylindrical stem portions;
- a tubular sleeve with a first diameter, which longitudinally extends between a first end and a second end, partially encasing the rock bolt such that at least a proximal end portion of the bolt projects from the first end of the sleeve;
- a grout-input element which engages the rock bolt on the proximal end portion and which engages the first end of the sleeve in sealing contact;
- wherein, over each stem portion, the tubular sleeve is adapted along at least one band section by a reduction in the first diameter in at least one diametric plane; and
- wherein, over the at least one anchor portion, the tubular sleeve retains the first diameter.

Preferably, the tubular sleeve is adapted along at least one band section by a reduction in the first diameter in a plurality of diametric planes.

More preferably, the tubular sleeve is adapted along at least one band section by a circumferentially uniform reduction in the first diameter to a second diameter.

The at least one band section, over each stem portion, may extend the length of the respective stem portion.

The sleeve may be adapted, over each stem portion, along a plurality of band sections. Preferably, a band section is formed at each end of the at least one anchor portion. In this way, the sleeve is prevented from axial movement relatively to the rock bolt thereby to maintain the sealing contact between the element and the sleeve.

Each band section may be at least 1 cm long, at least 2 cm long, at least 3 cm long, at least 4 cm long, at least 5 cm long, at least 6 cm long, at least 7 cm long, at least 8 cm long, at least 9 cm long or at least 10 cm long.

The tubular sleeve may be adapted by a swaging, compressive or moulding action.

The grout-input element may have a body with a central recess which is adapted to engage the rock bolt on the proximal end portion, which is adapted at a forward end to engage the first end of the sleeve in sealing contact, and which has at least one grout inlet which communicates an exterior of the element with the recess.

The at least one integrally formed anchor portion may comprise a plurality of serially arranged paddle formations which may be consecutively serially arranged.

Each paddle formation may extend laterally from the elongate cylindrical body of the rock bolt in two diametrically opposed radial directions.

The body may include a first and a second integral anchor portion, with a first stem portion between the proximal end and the first integral anchor portion, a second stem portion between the first integral anchor portion and the second integral anchor and a third stem portion between the second integral anchor and the distal end.

The invention extends to a first method of manufacturing an adhesively anchored rock bolt assembly with improved anchoring properties which includes the steps of:

a. providing a rock bolt with an elongate body which extends between a distal end and a proximal end and which has at least one integrally formed anchor portion and, where the body is not so formed, a plurality of cylindrical stem portions;
b. providing a tubular sleeve with a first diameter that longitudinally extends between a first end and a second end;
c. inserting the rock bolt through the sleeve so that the rock bolt extends past ends of the sleeve; and
d. over each stem portion, compressing the sleeve along at least one band section in at least one diametric plane to reduce the diameter of the sleeve in that diametric plane from the first diameter.

The tubular sleeve may be compressed along the at least one band section in a plurality of diametric planes.

Alternatively, the tubular sleeve may be circumferentially compressed along the at least one band section to provide a uniform reduction diameter from the first diameter to a second diameter.

The at least one band section, over each stem portion, may extend the length of the respective stem portion.

The sleeve may be compressed, over each stem portion, along a plurality of band sections.

Preferably, the sleeve is compressed along a band section which is formed at each end of the at least one anchor portion.

A further extension of the invention provides a second method of manufacturing an adhesively anchored rock bolt assembly with improved anchoring properties which includes the steps of:

a. providing an elongate cylindrical shank of a suitable metal material;
b. providing a tubular sleeve of a suitable metal material;
c. inserting the shank through the sleeve so that shank extends past ends of the sleeve; and
d. compressing the sleeve onto the shank at intervals along the sleeve to form both the sleeve and the shank with a plurality of corresponding paddle formations, each of which extends laterally, beyond a preformed limit of the sleeve and the shank respectively, in a single plane

BRIEF DESCRIPTION OF THE DRAWINGS

The invention is described with reference to the following drawings in which.

DESCRIPTION OF PREFERRED EMBODIMENTS

Figure 1:
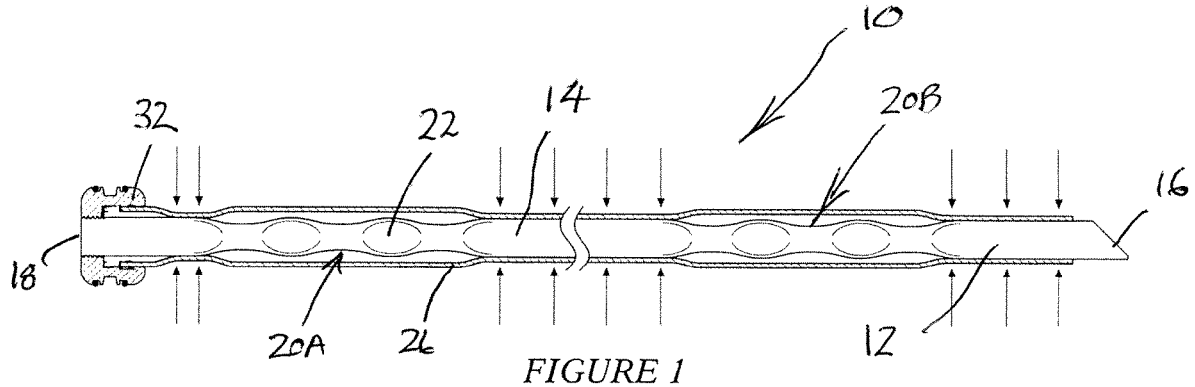
FIG. 1 and FIG. 2 diagrammatically illustrate longitudinal sections through a rock bolt assembly in accordance with the invention.
Figure 2:
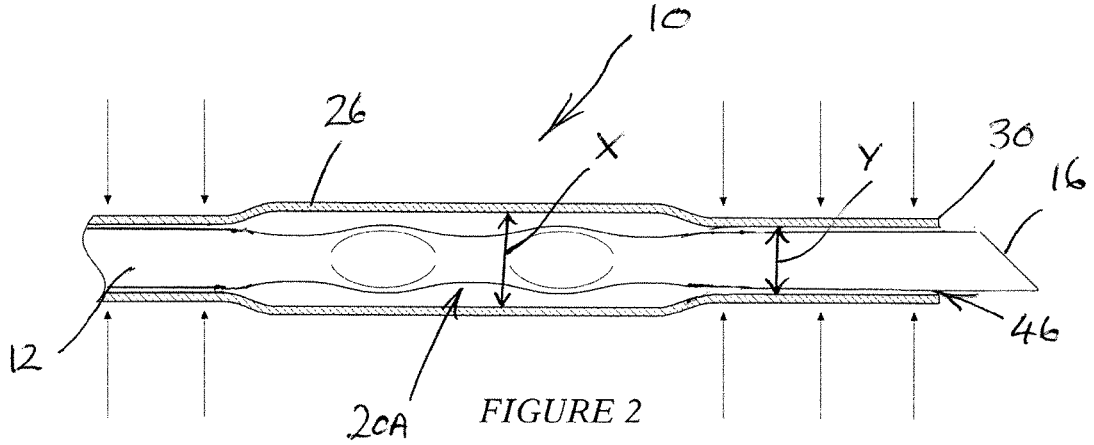

Referring to FIGS. 1 and 2 of the accompanying drawings, a rock bolt assembly 10 is provided in accordance with the invention.

The assembly includes a rock bolt 12 having an elongate metal body or shank 14 which extends between a distal end 16 and a proximal end 18. The blank of the rock bolt body typically is cylindrical, before being pre-formed with a plurality of integrally formed anchor portions. In this example, there is a first anchor portion 20A and a second anchor portion 20B. Each anchor portion comprises a plurality of end-to-end, or consecutive, paddle formations 22. The sections of the rock bolt body which are not so formed define stem portions of which there are three in the example illustrated in FIGS. 1 to 5, a first stem portion 23A between the proximal end 18 and the first anchor portion 20A, a second stem portion 23B between the first and the second anchor portions (20A, 20B) and a third short stem portion 23C between the second anchor portion 20B and the distal end 16 (see FIG. 4).

The body has a threaded end section 24 which ends at the proximal end 18. The distal end 16 can be adapted with, or attached to, a penetrative end section or element. Alternatively, but not shown, the distal end can be adapted for a self-drilling application.

The assembly 10 includes an elongate tubular sleeve 26, of a suitable metal material, which extends between a first end 28 and a second end 30. It is into the sleeve that the rock bolt 12 is inserted to provide a rock-bolt sleeve. The sleeve partially but substantially encloses the rock bolt 12, with proximal and distal ends (18, 16) of the bolt extending beyond the first end and second ends (28, 30) respectively of the sleeve.

Prior to any forming steps that follow in adapting the sleeve to provide the rock bolt assembly 10 of the invention, the sleeve has a uniform cylindrical first diameter, the internal diameter of which is shown in FIG. 2, designated X.

Figure 3:
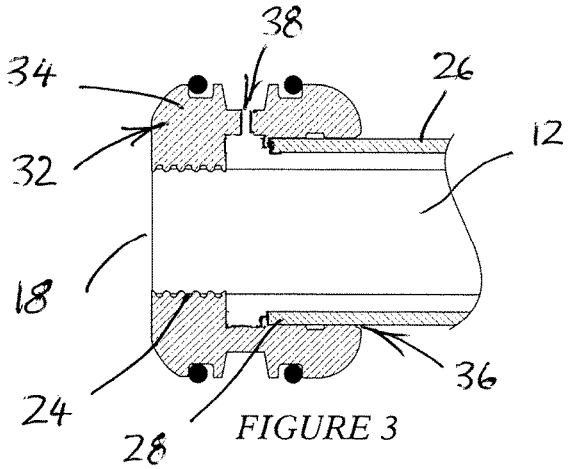
FIG. 3 is a longitudinal section of a proximal-end section of the rock bolt assembly of FIG. 1.
Figure 4:
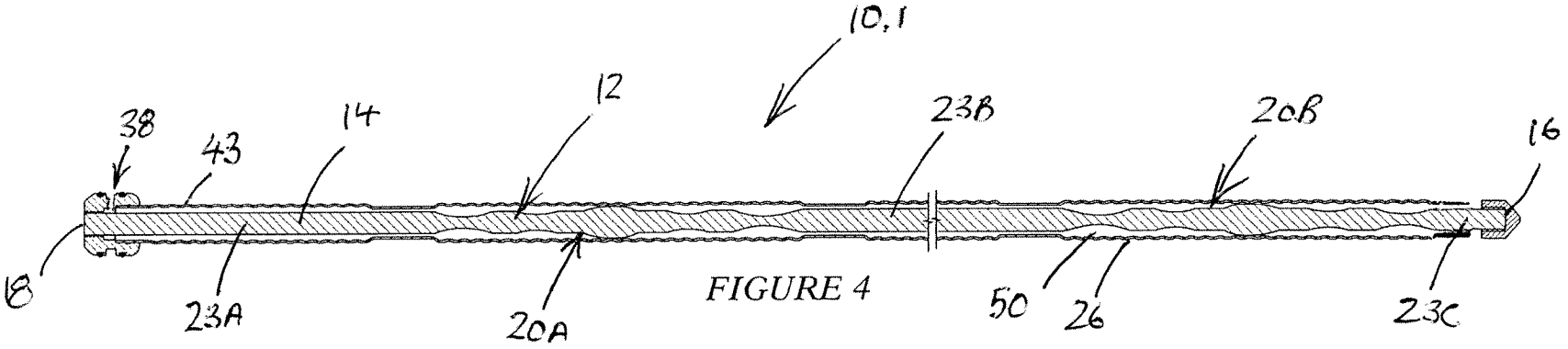
FIGS. 4 and 5 illustrate, in longitudinal section, a rock bolt assembly in accordance with a first embodiment of the invention.
Figure 5:
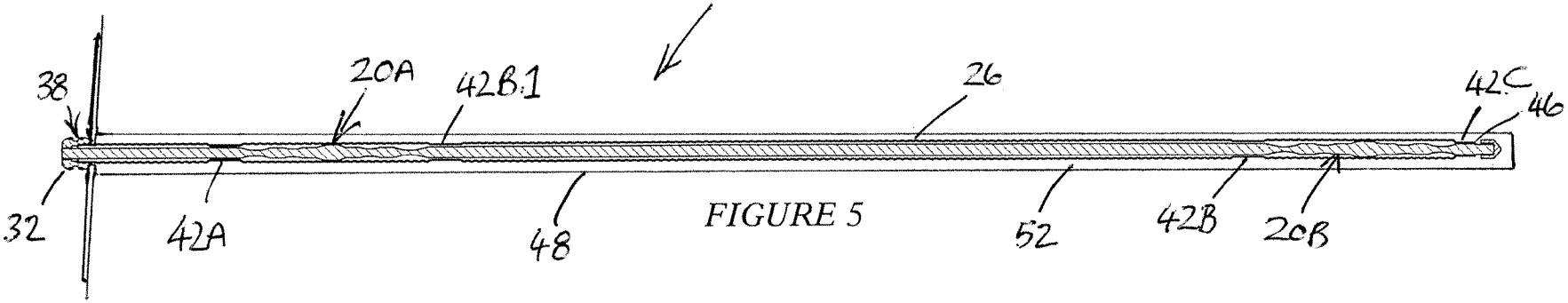

As best illustrated in FIG. 3, the assembly 10 further includes a grout-input element 32. In this example, the element is comprised of a unitary, machine pressed or cast, cylindrical steel body 34 which is adapted to engage a nozzle of a grouting apparatus. The body has a central hole 36 which is partially threaded and it is into this threaded section of the hole that the threaded end section 24 of the rock bolt 12 is fastened. In a sidewall of the body, a grout inlet 38 is provided. The first end 28 of the sleeve sealingly engages with the body 34 of the element 32, with the first end 28 abutting an annular ridge 40 within the hole.

Figure 6:
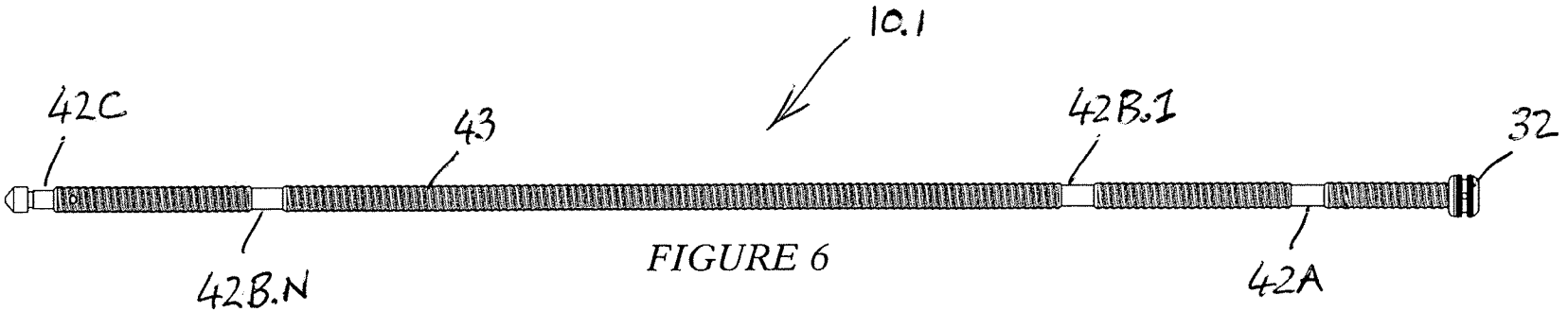
FIG. 6 is the first embodiment of the invention in elevation.

After the rock bolt 12 is inserted in to the sleeve 26, the sleeve is adapted in accordance with a first method of the invention as described below. In applying the method, over the stem portions (23A, 23B and 23C) of the rock bolt, the sleeve is compressed (the action of compression is illustrated with arrows on FIGS. 1 and 2) along at least one band section 42 (best illustrated in FIGS. 6 to 8), per stem portion, by a reduction in the first diameter in at least one diametric plane, wherein, over the anchor portions, the tubular sleeve retains the first diameter. A number of embodiments are provided from the various permutations of band section number and compression pattern.

Regarding compression pattern, in the examples illustrated in FIGS. 1 to 8, the sleeve 26 is compressed by swaging along the at least one band section 42 by a circumferentially uniform reduction in the first diameter (see FIG. 9A) to a second diameter which is shown in FIG. 2, designated Y.

Regarding number of band sections, in one embodiment 10.1 (illustrated in FIGS. 4, 5 and 6) there are four band sections respectively designated 42A, 426.1, 426.2 and 42C, one each over stem portions 23A and 23C, and two (426.1, 426.2) over stem portion 23B, located against anchor portion 20A and 20B respectively. Positioned in this way, the stem portions are effectively sandwiched between the inward recess of the band sections, preventing axial movement of the rock bolt 12 relatively to the sleeve 26 thus maintaining the seal between the sleeve and the grout-input element 32. Each of these band sections are relatively short sections but having a length of at least 10.3 m.

Figure 7:
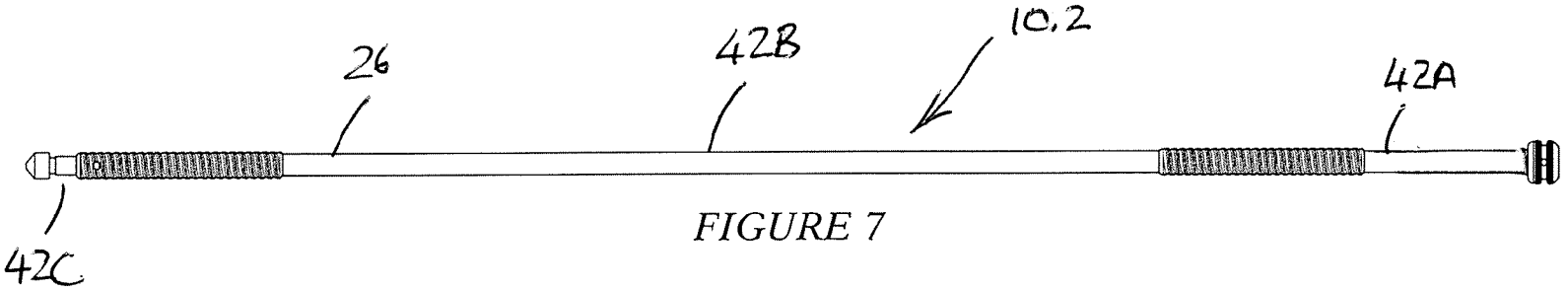
FIG. 7 is a second embodiment of the invention in elevation.

FIG. 7 illustrates another embodiment 10.2 in which, over each stem portion, the sleeve is adapted with a single band section that extends the length of the respective stem portion.

Figure 8:
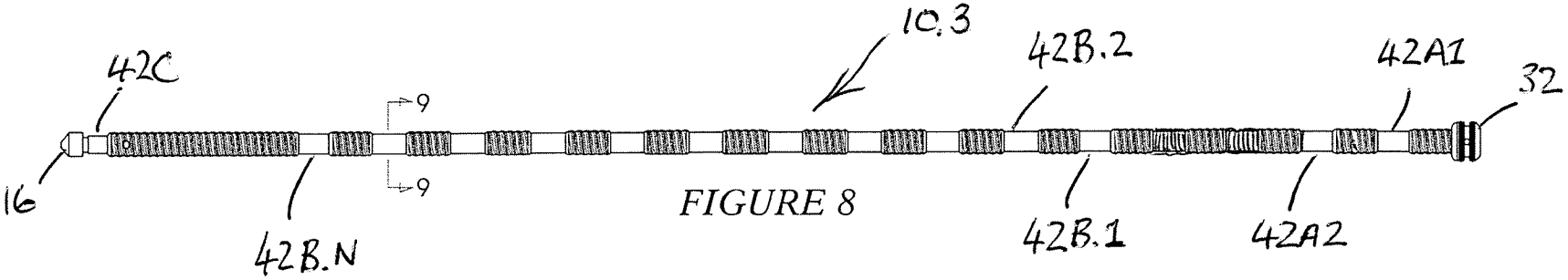
FIG. 8 is a third embodiment of the invention in elevation.
Figure 9A:
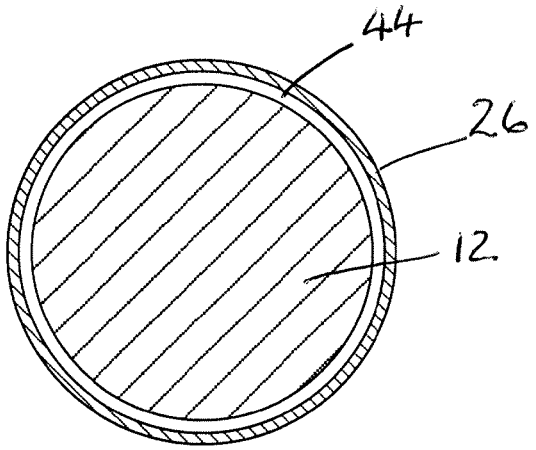
FIGS. 9A and 9B are alternative cross-sectional views through line 9-9 on FIG. 8.

In a further embodiment 10.3, shown in FIG. 8, over the length of each stem portions, the sleeve is adapted with band sections which, over stem portion 23A, is a plurality designated 42A.1, 42A.2, over stem portion 23B, is a plurality designated 42B.1, 42B.2 . . . 42BN, and over stem portion 23C, is a single section designated 42C.

As illustrated in FIGS. 4 to 8, where the sleeve 26 is not adapted with a band section, the sleeve is typically profiled with a series of ridges 43. This does not limit the scope of the invention and is merely an optional feature.

Figure 9B:
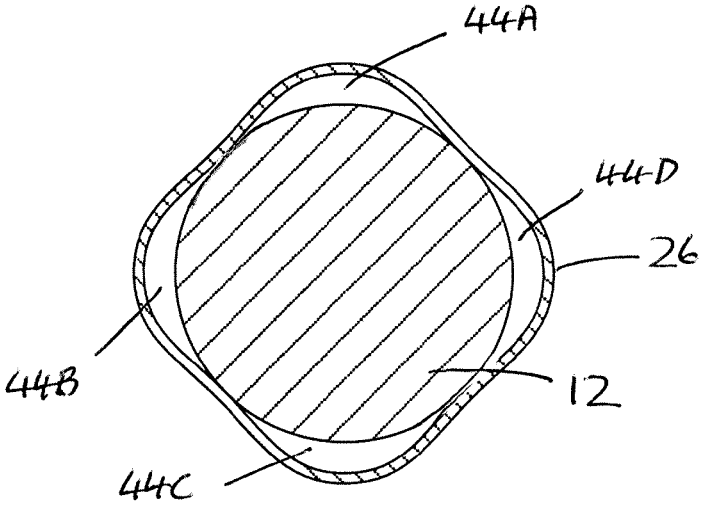

Compression of the sleeve, brings the wall of the sleeve into close proximity with the rock bolt 12, however there remains sufficient clearance between the sleeve and the rock bolt to provide an annular grout conduit 44 (see FIG. 9A) or a plurality of grout channels 44A, 44B . . . 44C (see FIG. 9B) through which the grout can pass freely as will be more fully described below. A grout conduit is thereby provided between the grout inlet 38 of the grout input element 32, a grout outlet 46 at the second end 30 of the sleeve 26 and the grout passage 48 which includes the conduit or channels 44, between the inlet and the outlet.

In use of the rock bolt assembly 10, now inserted in a pre-drilled rock hole 48 (see FIG. 5), a grout input nozzle (not shown) is engaged to the grout input element 32. The nozzle is connected to a grout supply line that feeds a grout pumped from a source to the nozzle, through the inlet 38, along the grout passage and out of the outlet 46. Thereafter, the grout will percolate into an annular space between the sleeve 26 and the rock hole. On hardening, the grout will adhere the rock bolt to the sleeve (in a first grout column 50) and the sleeve to the rock hole (in a second grout column 52). With the paddle formations 34 of the rock bolt and the recessed band sections 42 of the sleeve acting resistively on the first grout column and the second grout column respectively, when load is applied, the installation will exhibit improved anchoring.

The applicant has found that merely profiling the sleeve with the ridges 43 as mentioned did not provide sufficient purchase with the grout columns (50, 52) to achieve the maximum possible load transfer from rock bolt to the first grout column, to the sleeve, to the second grout column and ultimately to the rock. To maximise this load transfer, a mechanical anchor is necessary as mentioned in the preamble. It came as a surprise to the applicant that by altering the geometry of the sleeve, in accordance with the invention, markedly improved the anchor properties of the rock bolt assembly, dispensing with the need to have the mechanical anchor.

In manufacturing the rock bolt assembly 10 in accordance with the first method to provide any of the embodiments described above, the rock bolt body 14 blank is inserted into the sleeve 24, preformed with the anchor portions (20A, 20B), so that the rock bolt extends past ends (28, 30) of the sleeve. The grout-input element 32 is then engaged with the threaded end 24 of the bolt. Thereafter, over each stem portion, the sleeve is compressed, preferably by swaging, along at least one band section in at least one diametric plane to reduce the diameter of the sleeve in that diametric plane from the first diameter.

In a preferred embodiment, each band section is provided by compressing the sleeve 26 circumferentially uniformly to reduce the first diameter (see FIG. 9A) to the second diameter. In swaging, when actuating the swaging tool jaws, the operator will ensure that the sleeve is not compressed over the respective band section to such an extent as to occlude a grout conduit or channel 44.

Figure 10:
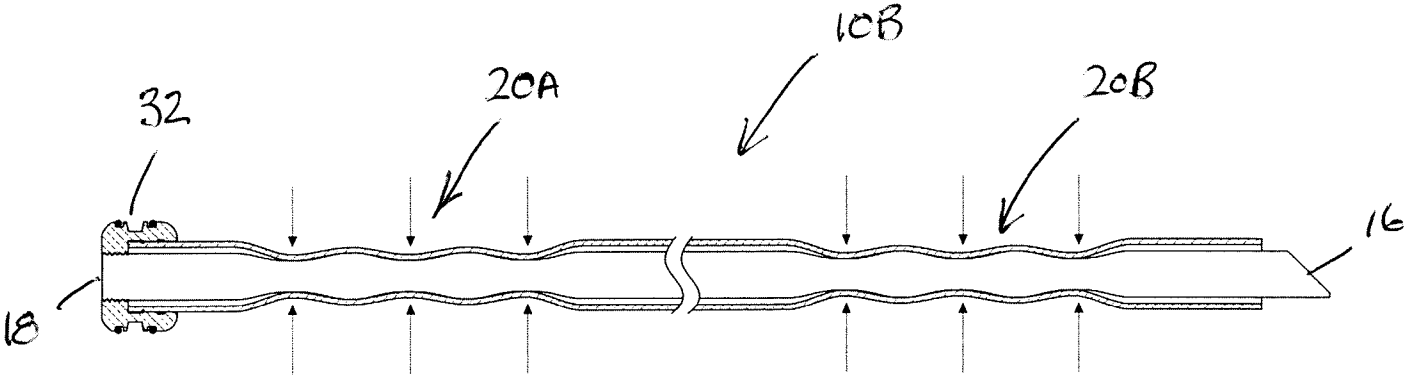
FIGS. 10 and 11 diagrammatically illustrate longitudinal sections through a rock bolt assembly adapted in accordance with a second method of the invention.
Figure 11:
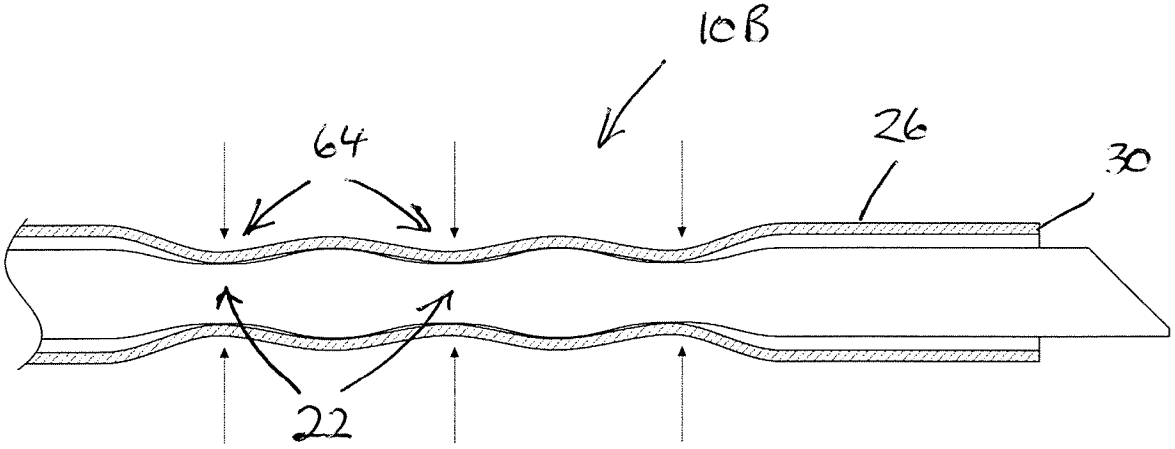

Referring to FIGS. 10 and 11, a rock bolt assembly 10B is provided. This assembly differs from the assembly 10 in that the sleeve 26 and the rock bolt 12 are compressed together in a single step, forming the sleeve and the anchor portions 20 on the rock bolt. The second method provides this assembly 10B and involves an assembly step and a forming process.

In the assembly step, the rock bolt body 14 blank is inserted in the sleeve 26, prior to the sleeve's forming, and the grout input element 32 is threadedly engaged to the rock bolt's threaded end section 24 which extends from the sleeve.

Figure 14:
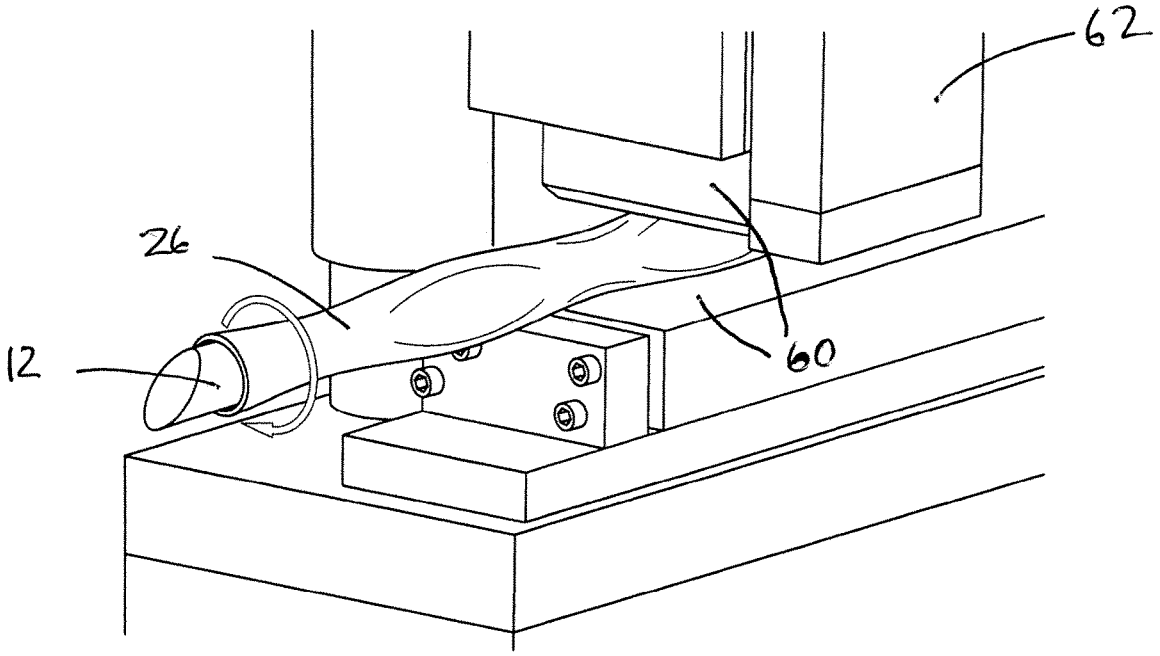
Figure 15:
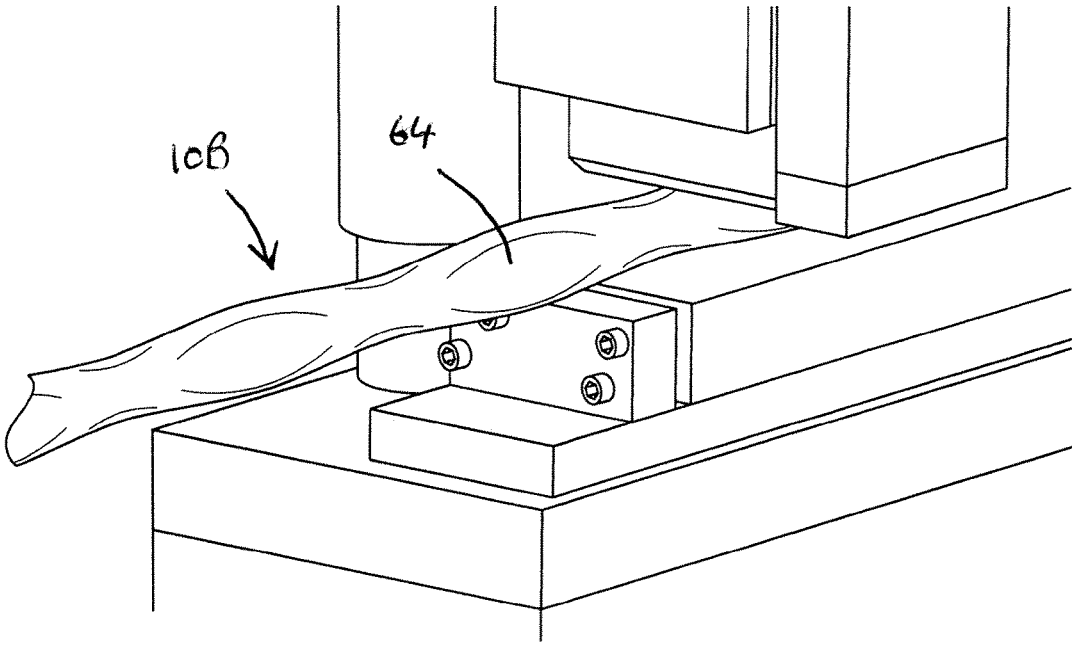

The forming process is shown, in process steps, in FIGS. 14 to 15, and the resultant assembly 10B is shown in FIGS. 10 and 11.

Figure 12:
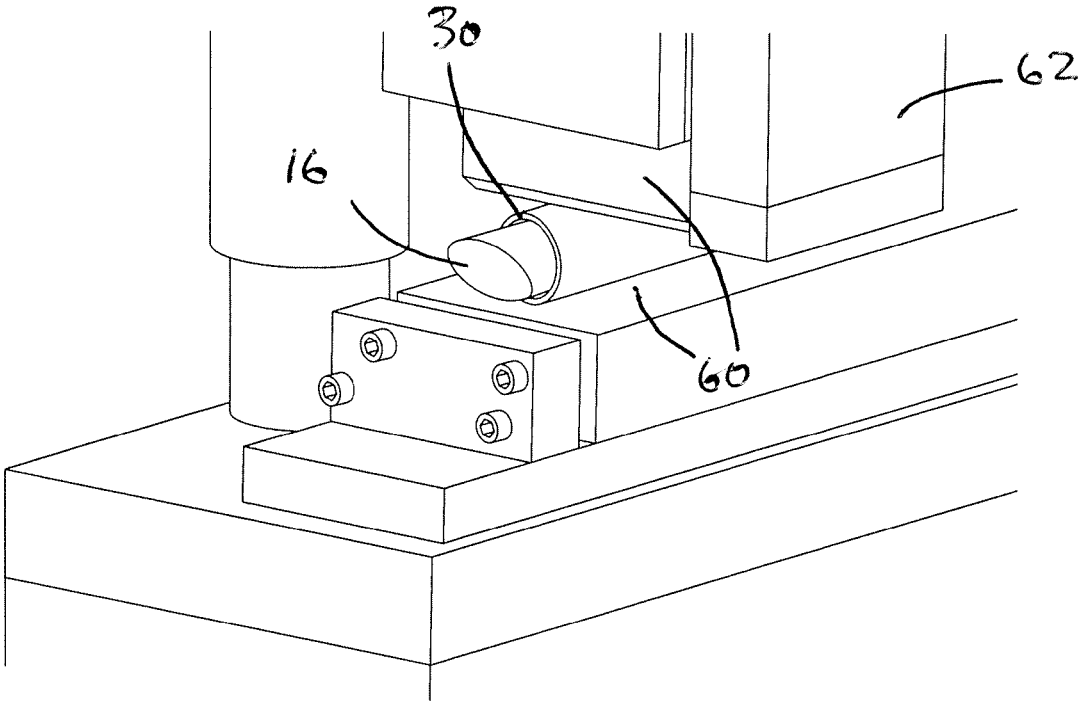
FIGS. 12 to 15 illustrate in sequence, steps employed in the second method.
Figure 13:
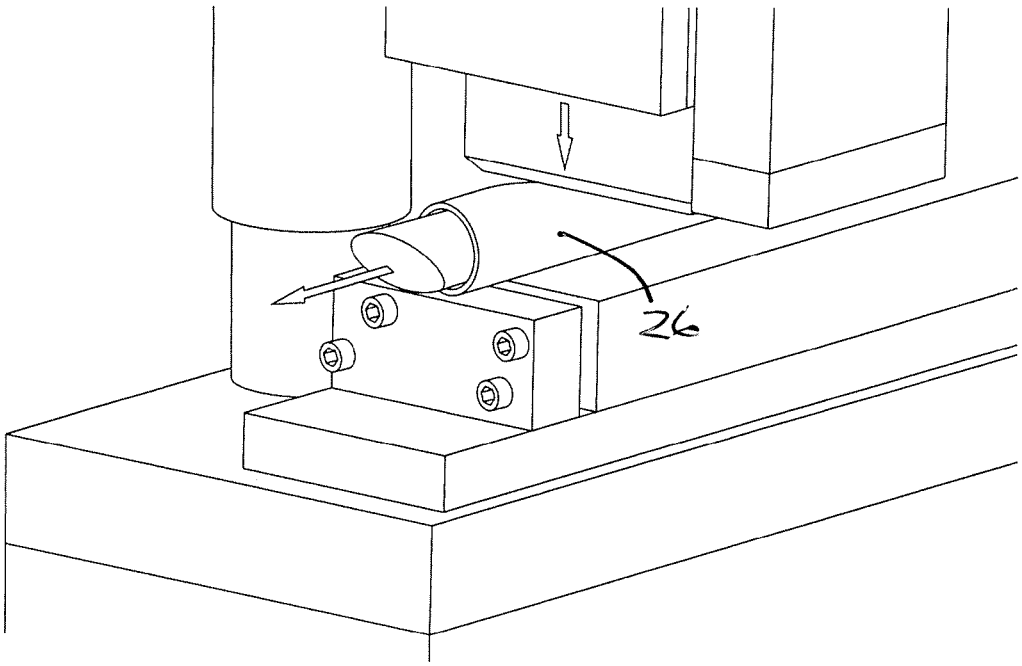

The rock bolt-sleeve assembly is inserted between a pair of dies 60 of a press 62 (FIG. 12). Actuating the press will cause an upper die to compress onto the assembly flattening the sleeve onto the rock bolt, providing a compression 64 in the sleeve and, simultaneously, forming into the rock bolt 14 a corresponding paddle formation 22 of an anchor portion 20 (FIG. 13 and FIGS. 10 and 11).

By repeating the process (see FIGS. 14 and 15), whilst moving the assembly axially incrementally along and simultaneously turning the assembly, a plurality of serially arranged paddle formations 22, constituting an anchor portion 20, and corresponding compressions 64 is provided, wherein each paddle (and corresponding compression) is radially offset relatively to the preceding.

The invention claimed is:

1. A rock bolt assembly comprising:

a rock bolt with a rigid elongate body which extends between a distal end and a proximal end and which has, at least one integrally formed anchor portion, comprising paddle formations, and a plurality of separate cylindrical stem portions, a tubular sleeve, of a metal material, which longitudinally extends between a first end and a second end, the tubular sleeve having a continuous first diameter over at least a portion of the tubular sleeve, the tubular sleeve partially encasing the rock bolt such that at least a proximal end portion of the bolt projects from the first end of the sleeve, and a grout-input element which engages the rock bolt on the proximal end portion and which engages the first end of the sleeve in sealing contact, wherein, over each stem portion, the tubular sleeve is adapted along at least one band section by a reduction in the first diameter in at least one diametric plane, and wherein, over the at least one anchor portion, the tubular sleeve retains the first diameter.

2. The rock bolt assembly according to claim 1, wherein the tubular sleeve is adapted along the at least one band section by a reduction in the first diameter in a plurality of diametric planes.

3. The rock bolt assembly according to claim 2, wherein the at least one band section, over each stem portion, extends the length of the respective stem portion.

4. The rock bolt assembly according to claim 2, wherein the at least one band section comprises a plurality of band sections.

5. The rock bolt assembly according to claim 1, wherein the tubular sleeve is adapted along the at least one band section by a circumferentially uniform reduction in the first diameter to a second diameter.

6. The rock bolt assembly according to claim 5, wherein the at least one band section comprises a plurality of band sections.

7. The rock bolt assembly according to claim 1, wherein the at least one band section, over each stem portion, extends the length of the respective stem portion.

8. The rock bolt assembly according to claim 1, wherein the at least one band section comprises a plurality of band sections.

9. The rock bolt assembly according to claim 8, wherein a band section is formed at each end of the at least one anchor portion.

10. The rock bolt assembly according to claim 1, wherein each band section is at least 1 cm long.

11. A method of manufacturing an adhesively anchored rock bolt assembly with improved anchoring properties, the method comprising:

a. providing a rock bolt with a rigid elongate body which extends between a distal end and a proximal end and which has at least one integrally formed anchor portion, comprising paddle formations, and a plurality of separate cylindrical stem portions;

b. providing a tubular sleeve, comprising a metal material, with a first diameter that longitudinally extends between a first end and a second end;

c. inserting the rock bolt through the sleeve so that the rock bolt extends past the ends of the sleeve; and d. over each stem portion, compressing the sleeve along at least one band section in at least one diametric plane to reduce the diameter of the sleeve in that diametric plane from the first diameter.

12. The method according to claim 11, wherein the tubular sleeve is compressed along the at least one band section in a plurality of diametric planes.

13. The method according to claim 12, wherein the at least one band section, over each stem portion, extends the length of the respective stem portion.

14. The method according to claim 12, wherein the at least one band section comprises a plurality of band sections.

15. The method according to claim 11, wherein the tubular sleeve is circumferentially compressed along the at least one band section to provide a uniform reduction from the first diameter to a second diameter.

16. The method according to claim 15, wherein the at least one band section, over each stem portion, extends the length of the respective stem portion.

17. The method according to claim 11, wherein the at least one band section, over each stem portion, extends the length of the respective stem portion.

18. The method according to claim 11, wherein the at least one band section comprises a plurality of band sections.

19. The method according to claim 18, wherein the sleeve is compressed along a band section which is formed at each end of the at least one anchor portion.

20. A rock bolt assembly comprising:

a rock bolt with a rigid elongate body which extends between a distal end and a proximal end, the rock bolt comprising:

at least one integrally formed anchor portion, each comprising paddle formations; and a plurality of cylindrical stem portions, respective ones of the cylindrical stem portions separated from one another by one of the anchor portions;

a metal tubular sleeve extending longitudinally between first and second ends, the rock bolt being arranged generally inside the metal tubular sleeve with the proximal end of the bolt projecting outside the first end of the metal tubular sleeve; and a grout-input element configured to be in sealing contact with both the proximal end of the rock bolt and the first end of the metal tubular sleeve, wherein, over each said at least one anchor portion of the rock bolt, the metal tubular sleeve has a first inside diameter and a first outside diameter, and wherein, over each of the cylindrical stem portions of the rock bolt, the metal tubular sleeve has an inside diameter that is less than the first inside diameter, and an outside diameter that is less than the first outside diameter.

* * * * *